United States Patent [19]

Smith

[11] Patent Number: 4,633,537

[45] Date of Patent: Jan. 6, 1987

[54] COMBINATION CRIB/CABINET UNIT

[76] Inventor: Ralph Smith, 3513 Emmett Pl., Santa Clara, Calif. 95051

[21] Appl. No.: 730,631

[22] Filed: May 6, 1985

[51] Int. Cl.[4] ..... A47B 85/00; A47D 7/00

[52] U.S. Cl. ..... 5/2 R; 5/93 R; 5/99 R; 5/159 R

[58] Field of Search ..... 5/2 R, 3, 4, 159 R, 5/159 B, 160, 161, 93 R, 93 B, 99 R, 99 B

[56] References Cited

U.S. PATENT DOCUMENTS 730,391 6/1903 Owen ..... 5/159 R
2,711,544 6/1955 Bystrom ..... 5/2 R

FOREIGN PATENT DOCUMENTS 480983 8/1929 Fed. Rep. of Germany ..... 5/161
419051 12/1910 France ..... 5/60
1227651 8/1960 France ..... 5/2 R

*Primary Examiner*—Alexander Grosz
*Attorney, Agent, or Firm*—Flehr, Hohbach, Test, Albritton & Herbert

[57] ABSTRACT

A combination crib/cabinet unit is disclosed herein. This unit includes an overall housing having a pair of vertically extending front doors which together with the rest of the housing present the appearance of a self-standing cabinet substantially narrower than a crib. At the same time, the front doors open out and together with other components of the unit form a crib with the doors serving as end members.

6 Claims, 6 Drawing Figures

COMBINATION CRIB/CABINET UNIT

The present invention relates generally to household furniture and more particularly to a unit which alternatively serves as a relatively narrow cabinet and a relatively deep crib.

There are presently available what may be referred to as portable cribs which are designed to fold up and store in a closet or other location out of sight. The typical portable crib is not designed to remain in view in its folded away position, as it is not particular attractive in that state. On the other hand, where space is a premium and there are no closets, garages or basements to hide a portable crib when it is not in use or in the case where it is difficult or inconvenient for the user to physically move the folded crib to a particular location out of sight, the use of such a crib may not be possible or at least practical. At the same time, the user may not have the room to house a crib in its crib standing position all the time.

In view of the foregoing, it is an object of the present invention to provide a crib which, while remaining in the same room, may be readily converted to an ascetically appealing piece of furniture when the crib is not in use, preferably a functional piece of furniture such as a cabinet unit which can support knick-knacks and useful articles on its top surface.

Another object of the present invention is to design the combination crib/cabinet unit such that when the crib is converted to a cabinet unit the latter takes less space on the floor than the crib.

Still another object of the present invention is to provide the combination crib/cabinet unit in a way which makes it possible to convert from one to another in an uncomplicated manner with minimal physical effort.

As will be discussed hereinafter, the combination crib/cabinet unit disclosed herein includes an overall housing which has the exterior appearance of a self-standing cabinet. It also includes a base member designed to carry a crib mattress and a front wall which, in a preferred embodiment, serves as a typical slatted railing of a crib.

The housing itself includes a lower most base end, opposite side walls and a back wall extending vertically upward from the base end. A closed top side connects the top ends of the side walls and back wall, and a pair of vertically extending doors serve alternatively as the front doors of the cabinet unit and the end walls of the crib. These vertically extending doors are respectively hinge connected to the side walls of the housing for movement between first closed positions in a common plane normal to the housings side walls for closing the front side of the housing when the latter is in the form of a cabinet unit and second, opened positions extending out from the front side of the housing parallel with the side walls, whereby to function as the end walls of the crib.

The base member is pivotally connected with the inside surface of the back wall of the housing for movement between a vertically extending first position and a horizontal second position. In its vertically extending first position, the base member is adjacent the back wall, between and within the confines of the side walls, whereby the housing doors can be closed and thereby hide the base member. The base member can be moved to its second horizontal position when the front doors are in their opened positions such that it extends out from the back wall of the housing between and within the confines of the opened doors for supporting a mattress thereon.

Finally, the front wall or crib railing of the combination crib/cabinet unit is pivotally connected with the base member just recited for movement between a first position parallel with and adjacent to the base member and a second position perpendicular to the base member. When the crib railing is in its horizontally extending second position, the front wall is movable between a first horizontal position directly over and adjacent the base member and a second vertical position to one side of the base member opposite the back wall of the housing and between the opened doors, whereby the back wall, crib railing, the opened doors and the base member together define a crib.

The combination crib/cabinet unit just discussed briefly will be discussed in more detail hereinafter in conjunction with the drawings wherein.

Figure 1:
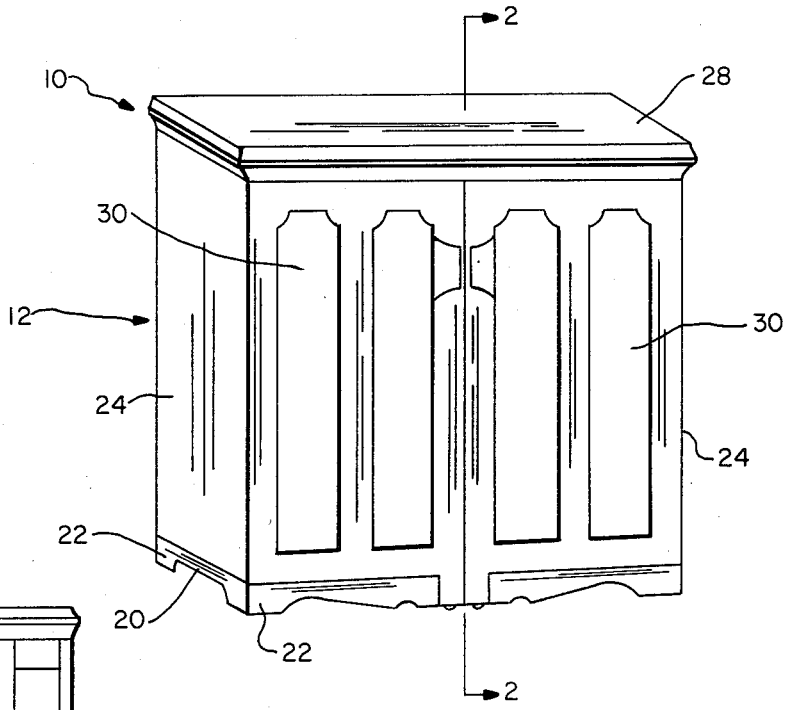
FIG. 1 is a perspective view of the combination crib/cabinet unit designed in accordance with the present invention and shown functioning as a cabinet.
Figure 2:
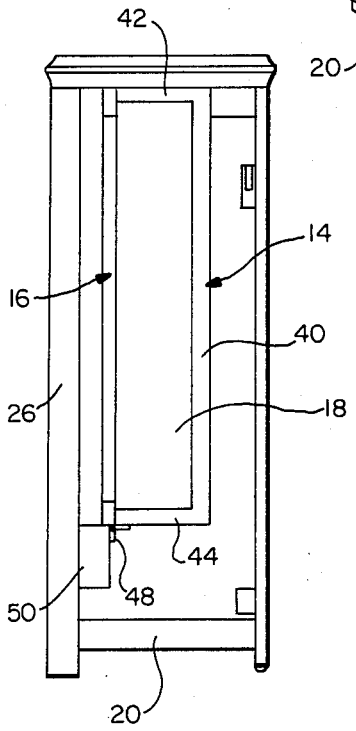
FIG. 2 is a vertical sectional view of the combination crib/cabinet unit of FIG. 1, taken generally taken along line 2—2 in FIG. 1.

Turning now to the drawings, wherein like components are designated by like reference numerals throughout the various Figures, attention is first directed to FIGS. 1 and 2 which illustrate a combination crib/cabinet unit designed in accordance with the present invention and shown in a folded away condition functioning as a cabinet. The combination unit, generally indicated by the reference numeral 10, is shown including an overall housing 12, a base member 14 (see FIG. 2) and what may be referred to as a front wall 16 (also see FIG. 2). As will be discussed hereinafter, the overall housing has the exterior appearance of a self-standing cabinet and, at the same time, functions to contain all of the other components making up the combination unit. The base member 14 which is contained entirely within the housing when the combination unit functions as a cabinet is designed to support a crib mattress 18. The front wall 16 is carried by base member 14 and, as will be seen, serves as a slatted crib railing when the combination unit functions as a crib.

The overall housing 12 of combination unit 10 is shown including a lower base end 20 supported by corner legs 22 and opposite side walls 24 and back wall 26 extending vertically upward from base end 20. A closed top side 28 connects the top ends of side walls and back wall 26 and functions as a support surface for knick-knacks or useful articles, whether or not the combination unit is functioning as a crib or cabinet. In this way, the knick-knacks or useful articles never have to be removed from the surface of topside 28.

Figure 3:
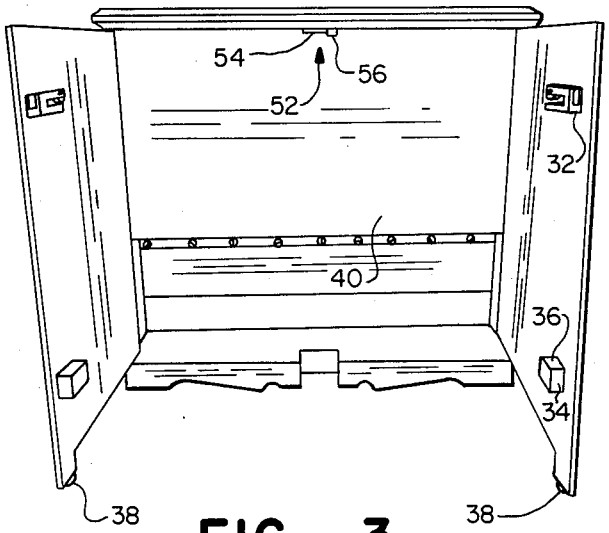
FIG. 3 is perspective view of the combination unit shown in a first step converting it from a cabinet to a crib.

In addition to the components described thus far, housing 12 includes a pair of vertically extending doors 30 respectively hinge connected by suitable means (not shown) to either the front faces of side walls 24 or the top and bottom ends of the housing adjacent the front faces of side walls 24. For example, conventional hinges could be provided for connecting the doors directly to the front faces of the side walls or hinge pins could be provided in openings at the top and bottom ends of the doors and in cooperating openings in the housing at its top and bottom ends. In any event, the doors are suitably mounted for movement between first closed positions in a common plane normal to the side walls 24 for closing the front side of the housing, as illustrated in FIGS. 1 and 2 and second, opened positions extending out from the front side parallel with the side walls, as illustrated in FIG. 3. As best seen in this latter figure, the inside surface of each of the doors 30 carries near its top end a latching mechanism 32 and near its bottom end a base member support 34 defining a horizontal shoulder 36. In addition, in order to readily move the doors between their closed and opened positions, each may include its own wheel or roller 38 suitably supported to its underside for rolling on the floor as the door is moved back and forth.

Figure 4:
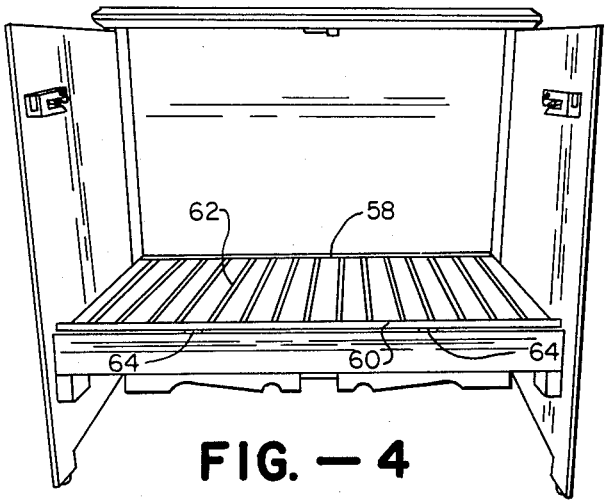
FIG. 4 is a perspective view of the combination unit shown in a second step for converting it from a cabinet to a crib.

Referring now to base member 14, the latter is shown including a closed, flat underside 40 (see FIGS. 2 and 3) and a rectangular frame extending up from and perpendicular with underside 40 along the outer periphery of the latter. The frame consists of a front section 42, a back section 44 and two side sections which together with the underside contain mattress 18. As best illustrated in FIG. 2, back section 44 of the frame forming part of base member 14 is pivotally connected by suitable hinge means 48 at its bottom end to a horizontally extending support plate 50 which is fixedly connected to the inner surface of back side 26 of housing 12 near the bottom end of the housing. In this way, the base member is moveable between a vertically extending position adjacent the back wall 26 between and within the confines of side walls 24 so that the front doors 30 can be closed, as illustrated best in FIG. 2, and a horizontal position when the doors are in their opened, FIG. 3 positions such that the base member extends out from the back wall between and within the confines of the opened doors, as best illustrated in FIG. 4. The base member is designed to support mattress 18 for movement with it between its vertical and horizontal positions.

Figure 5:
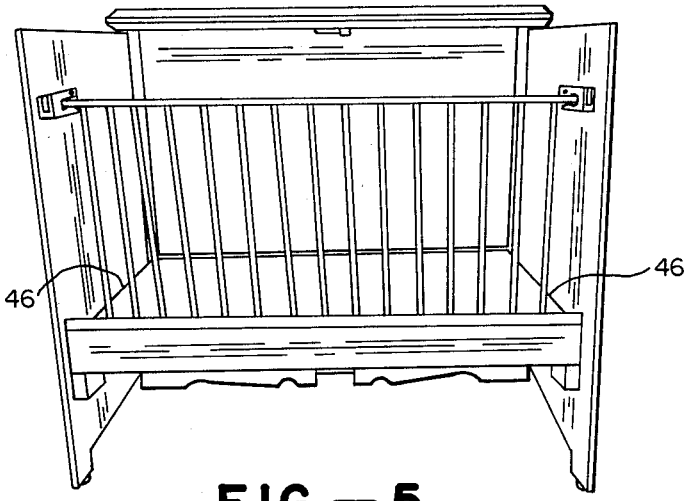
FIG. 5 is a perspective view of the combination crib/cabinet unit shown fully opened and functioning as a crib.

As best illustrated in FIGS. 2 and 3, the base member 40 is disengagably retained in its vertical position by means of a suitable latching mechanism 52 including a moveable abuttment 54 and actuator 56. The mechanism serves to maintain the base member and mattress 18 in the vertical position illustrated in FIGS. 2 and 3, even when the doors 30 are opened. In order to lower the base member and the mattress to the horizontal position illustrated in FIG. 4, it is only necessary to open the doors to their FIG. 3 positions and actuate the latch mechanism. The base member and mattress can then be pulled down about hinge means 48. Eventually underside 40 of the base member will come to rest on the shoulders 36 of supports 34. Referring now to FIGS. 4 and 5 in conjunction with FIG. 2, attention is directed to front wall 16 which, as stated previously, serves as a slatted crib railing when the combination unit functions as a crib. As best illustrated in FIG. 4, this crib railing includes spaced apart upper and lower main rails 58 and 60 respectively, which extend parallel with frame sections 42 and 44 of base member 14. The two main rails are connected to one another by laterally spaced secondary rails 62. The bottom main rail 60 is pivotally connected by means of hinges 64 to one edge of frame section 42 for movement between the first position parallel with and adjacent the base member and mattress 18 and a second position perpendicular to the base member. In other words, with the base member in its opened horizontal position, the railing is movable between a horizontal position against the mattress, as illustrated in FIG. 4, and a vertically extending position directly above frame section 42 between opened doors 30, as illustrated in FIG. 5. When the railing is in its horizontal FIG. 4 position, it merely rests on the mattress and moves into a closed position against the inside surface of back side 26 when the frame member is placed in its vertically extending closed position shown in FIG. 2. On the other hand, latching mechanisms 32 on doors 30 are provided for maintaining the railing in its vertical position of FIG. 5, as will be discussed immediately below in conjunction with FIG. 6.

Figure 6:
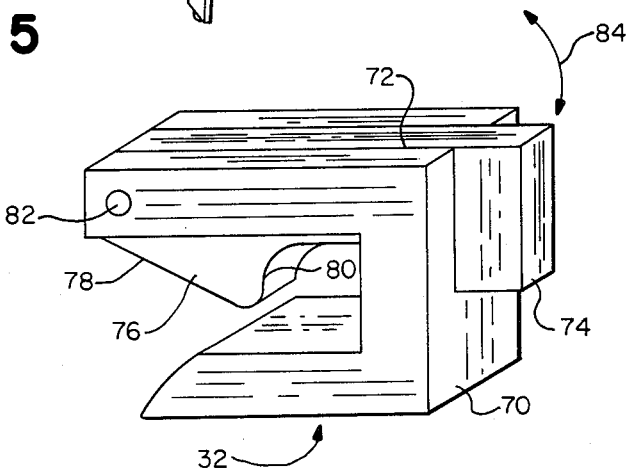
FIG. 6 is a perspective view of a latching mechanism forming part of the combination unit of FIGS. 1–5.

Turning to FIG. 6, one of the mechanisms 32 is shown in perspective view, specifically the mechanism carried by the right hand door 30, as viewed in FIG. 3. As seen in FIG. 6, mechanism 32 includes a generally U-shaped member 70 positioned on its side and fixedly connected to the inside surface of its associated door so that the opening of the U faces the inside of housing 12 when the door is opened. A slot 72 is provided through the top section of the U for containing a latch arm 74 having a segment 76 which defines a cammed surface 78 and a rearward shoulder 80. The latch 74 is pivotally connected within slot 72 by means of pivot pin 82 for pivotal movement between the position illustrated in FIG. 6 and a raised position outside the slot, as indicated by arrow 84.

The latch mechanism 32 on the other door 30 is identical to the one described above. Both are positioned so that the openings of their respective U-shaped members 70 face the interior of housing 12 when doors 30 are opened. They are also positioned so that as crib railing 16 is pulled upward to a vertical position from its horizontal position illustrated in FIG. 4, opposite end sections of the top railing 58 enter the openings in U-shaped members 70. As they do so, they ride on cam surfaces 78, causing the latches 74 to move upward and out of the way. Eventually, the railing segments move in beyond shoulders 80, thereby allowing the latches to fall back down into slots 72 around the railing segments, thereby preventing the railing segments from moving out of the U-shaped members. This locks the railing in its vertical position. In order to disengage the railing from the latch mechanisms, the latches first must be pulled upward.

From the foregoing, it should be apparent that combination crib/cabinet unit 10 can be readily converted with minimal effort to a crib from a cabinet and from a cabinet to a crib. It should be equally evident that when the unit functions as a cabinet it takes up substantially less floor space then it does when it is a crib. This is because all of the components making up the crib can be contained within the cabinet housing which is substantially narrower than the crib itself and because the crib can be made much wider by utilizing the front doors of the cabinet as end walls for the crib.

What is claimed is:

1. A combination crib/cabinet unit, comprising:

(a) an overall housing which has the exterior appearance of a self-standing cabinet, said housing including (i) a lowermost base end, (ii) opposite sidewalls and a back wall extending vertically upward from said base end, (iii) a closed topside connecting the top ends of said sidewalls and said backwall, and (iv) a pair of vertically extending doors respectively hinge connected to said sidewalls for movement between first closed positions in a common plane normal to said sidewalls for closing the frontside of the housing and second, open positions extending out from said front side parallel with said sidewalls;

(b) a base member pivotally connected with the inside surface of said backwall for movement between a vertically extending first position adjacent said backwall between and within the confines of said sidewalls whereby said housing doors can be closed and a second, horizontal position when said doors are in said open positions such that the base member extends out from said backwall between and within the confines of said open doors for supporting a mattress thereon; and (c) a front wall pivotally connected with said base member for movement between a first position parallel with and adjacent to said base member and a second position perpendicular to said base member such that, when the base member is in said horizontally extending second position, said front wall is movable between a first horizontal position directly over and adjacent said base member and a second vertical position to one side of the base member opposite said backwall and between said open doors, whereby said back and front walls, said open doors and said base member together define a crib;

(d) said base member including a mattress supporting underside and a frame around said underside and the combination crib/cabinet unit further including a mattress positioned over said underside and within the confines of said frame for movement with the base member between its vertically extending first position and its second, horizontal position; and (e) each of said vertically extending doors and said front wall including cooperating means for disengagably latching said front wall to said doors when the doors are in their second, opened positions and said front wall is in its second position with said base member in its second horizontal position, whereby to disengagably latch the combination crib/cabinet unit in its crib functioning condition.

2. A combination crib/cabinet unit according to claim 1 wherein said front wall is vertically slotted whereby to provide a crib type of side railing.

3. A combination crib/cabinet unit according to claim 1 wherein each of said vertically extending doors includes wheel means for supporting the door for movement between its first and second positions.

4. A combination crib/cabinet unit according to claim 1 wherein said back wall of said overall housing includes a horizontally extending plate member fixedly connected to its inside surface and wherein said base member is pivotally connected directly to said plate member for movement between its first and second positions.

5. A combination crib/cabinet unit according to claim 1 wherein each of said doors includes a support plate fixedly connected to its inside surface for supporting one end of said base member when the doors and base members are in their second positions.

6. A combination crib/cabinet unit, comprising:

(a) an overall housing which has the exterior appearance of a self-standing cabinet, said housing including (i) a lowermost base end, (ii) opposite sidewalls and a back wall extending vertically upward from said base end, (iii) a closed topside connecting the top ends of said sidewalls and said backwall, and (iv) a pair of vertically extending doors respectively hinge connected to said sidewalls for movement between first closed positions in a common plane normal to said sidewalls for closing the frontside of the housing and second, open positions extending out from said front side parallel with said sidewalls;

(b) a base member pivotally connected with the inside surface of said backwall for movement between a vertically extending first position adjacent said backwall between and within the confines of said sidewalls whereby said housing doors can be closed and a second, horizontal position when said doors are in said open positions such that the base member extends out from said backwall between and within the confines of said open doors for supporting a mattress thereon; and (c) a front wall pivotally connected with said base member for movement between a first position parallel with and adjacent to said base member and a second position perpendicular to said base member such that, when the base member is in said horizontally extending second position, said front wall is movable between a first horizontal position directly over and adjacent said base member and a second vertical position to one side of the base member opposite said backwall and between said open doors, whereby said back and front walls, said open doors and said base member together define a crib;

(d) each of said vertically extending doors and said front wall including cooperating means for disengagably latching said front wall to said doors when the doors are in their second, opened positions and said front wall is in its second position with said base member in its second horizontal position, whereby to disengagably latch the combination crib/cabinet unit in its crib functioning condition.

* * * * *